US012371908B1

(12) United States Patent
Compton et al.

(10) Patent No.: US 12,371,908 B1
(45) Date of Patent: Jul. 29, 2025

(54) GUTTER COVER

(71) Applicants: Andrew Joe Compton, Sherwood, AR (US); Keith Wayne Shephard, Beaverdam, KY (US)

(72) Inventors: Andrew Joe Compton, Sherwood, AR (US); Keith Wayne Shephard, Beaverdam, KY (US)

( * ) Notice: Subject to any disclaimer, the term of this patent is extended or adjusted under 35 U.S.C. 154(b) by 0 days.

(21) Appl. No.: 18/587,527

(22) Filed: Feb. 26, 2024

Related U.S. Application Data

(63) Continuation of application No. 18/344,103, filed on Jun. 29, 2023, now Pat. No. 11,913,230.

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01)

(58) Field of Classification Search
CPC ..... E04D 13/076; E04D 13/068
USPC ..... 52/12
See application file for complete search history.

(56) References Cited

U.S. PATENT DOCUMENTS 4,253,281 A * 3/1981 Ruttenberg ..... E04D 13/076 52/12
2005/0204641 A1* 9/2005 Collister ..... E04D 13/076 52/11
2012/0132759 A1* 5/2012 Sager ..... E04D 13/0762 248/49
2013/0097943 A1* 4/2013 Higginbotham ..... E04D 13/064 52/12
2016/0168859 A1* 6/2016 Vargas ..... E04D 13/064 52/716.2
2020/0354959 A1* 11/2020 Hicks ..... E04D 15/003

* cited by examiner

*Primary Examiner* — Babajide A Demuren
(74) *Attorney, Agent, or Firm* — Michael D. Eisenberg

(57) ABSTRACT

A gutter cover includes an upper hood panel, a lower cover panel, and a retractable plate. The upper hood panel is configured to be joined to an inclined roof sheathing covering rafters of a roof, to extend above a gutter and to no more than partially shield the gutter from above. The lower cover panel is configured to cover the gutter, such that a gap is present between the upper hood plate and the lower cover panel. The retractable plate is located above the lower cover plate, and configured to be movable between a retracted configuration at least partially within the gap and an extended configuration at least partially located outside the gap. The retractable plate comprises a rear portion and forward flap, the forward flap sloping upward from a forward edge of the rear portion. The lower cover panel has first openings. The retractable plate has second openings.

17 Claims, 15 Drawing Sheets

GUTTER COVER

TECHNICAL FIELD

This invention relates to rain gutters.

BACKGROUND OF THE INVENTION

A rain gutter or gutter is a component of a water discharge system for a building. Rain gutters are used to prevent water dripping or flowing off roofs in an uncontrolled manner for several reasons: to prevent water from damaging the walls and from drenching persons standing below or entering the building, and to direct the water to a suitable disposal site where it will not damage the foundations of the building.

A gutter collects the water flowing off a sloping roof and discharges the collected water to an appropriate location through a down pipe generally connected to the bottom of the gutter.

BRIEF SUMMARY OF EMBODIMENTS OF THE INVENTION

The inventors have found that the open configuration of rain gutters enables entry of foreign objects into the rain gutter. The foreign objects may be leaves, pine cones, bird nests, for example. These foreign objects may block the opening of the gutter into the down pipe and may clog the gutter and/or the downpipe, thereby preventing flow of water into and/or through the downpipe. Thus, water collected in the gutter may overflow from the gutter and be discharged onto undesirable locations, negating the effect of the gutter.

Moreover, the inventors have found that in some cases, rainwater may slide over an inclined roof at high speeds and flow over the gutter, bypassing the gutter.

An aim of the present invention is to protect the gutter from foreign objects. Another aim of the present invention is to prevent rainwater from flowing over the gutter and to direct fast flowing rainwater from the roof into the gutter.

Therefore, an aspect of some embodiments of the present invention relates to a gutter cover configured to cover a gutter joined to a fascia of a roof. The gutter cover includes an upper hood panel, a lower cover panel, and a retractable plate. The upper hood panel is configured to be joined to an inclined roof sheathing covering rafters of a roof, to extend above a gutter joined to a fascia joined to a front of the roof rafters, and to no more than partially shield the gutter from above. The lower cover panel is configured to be joined to the gutter and to cover the gutter, such that a gap is present between the upper hood plate and the lower cover panel. The retractable plate is located above the lower cover plate, and configured to be movable between a retracted configuration and an extended configuration. The retractable plate comprises a rear portion and forward flap, the forward flap sloping upward from a forward edge of the rear portion. In the retracted configuration, the retractable plate is retracted within the gap and is shielded by the upper hood panel from above. In the extended configuration, the retractable plate is at least partially located outside the gap and covers at least most of a forward portion of the lower cover panel, the forward portion of the lower cover panel being a portion that is not shielded by the upper hood panel. The lower cover panel has first openings to enable passage of water from the lower cover plate into the gutter. The retractable plate has second openings, to enable passage of from the retractable plate to the lower cover panel.

In a variant, the forward flap slopes upward and forward at an obtuse angle from the rear portion.

In another variant, the lower cover panel comprises a forward trough having a lip which is configured to be joined to a rim on the front end of the gutter. The first openings comprise a set of first front openings on the front trough. The second openings comprise a set of second front openings which align with the front trough of the lower cover panel when the retractable plate is in the extended configuration, such that water is led from the retractable plate into the front trough via the second front openings and is led from the front trough into the gutter via the first front openings.

In yet another variant, the lower cover panel further comprises a rear trough located between the forward trough and a rear end of the lower cover. The first openings comprise a set of first rear openings on the rear trough. The second openings comprise a set of second rear openings which align with the rear trough of the lower cover panel when the retractable plate is in the extended configuration, such that water is led from the retractable plate into the rear trough via the second rear openings and is led from the rear trough into the gutter via the first rear openings.

In some embodiments of the present invention, the gutter cover further comprises a motor, a circular gear and a track. The motor comprises a shaft and configured to rotate the shaft about a longitudinal axis of the shaft, the motor being configured to be fixed to at least one of: the gutter, the upper hood panel, and the lower cover panel. The circular gear is joined concentrically to the shaft and is configured to rotate with the shaft. The track is joined to a lateral side of the retractable plate and configured to mesh with the circular gear, such that rotation of the circular gear moves the track and thereby linearly moves the retractable plate to which the track is joined at least from the retracted configuration to extended configuration.

In a variant, the gutter cover comprises a solar panel configured to generate electricity to power the motor.

In another variant, the gutter cover comprises a spiral spring wound about the shaft with a first end joined to the shaft and a second end joined to a fixed location. The spiral spring is configured to tighten about the shaft as the shaft rotates to move the retractable plate from the retracted configuration to the extended configuration. When the motor stops rotation of the shaft, the motor stops applying torque to the shaft and the spiral spring is configured to unwind and thereby rotate the shaft to move the retractable plate from the extended configuration to the retracted configuration.

In yet another variant, the gutter cover comprises a spring having a first end joined to the retractable plate and a second end joined to the any part of the roof 50 or the upper hood panel or lower hood panel. The spiral spring is configured to extend when the retractable plate is moved from the retracted configuration to the extended configuration. When the motor stops rotation of the shaft, the motor stops applying torque to the shaft and the spring is configured to return to an equilibrium length thereof, thereby pulling the retractable plate from the extended configuration to the retracted configuration.

In a further variant, the gutter cover comprises a rain sensor and a control unit in communication with the motor. The rain sensor is configured to detect rainfall, and to generate a first signal when rainfall is detected. The control unit is configured to receive the first signal, identify a change between absence and presence of the first signal, and to control the motor to extend the retractable plate when a change from the absence to the presence of the first signal is identified and to retract the retractable plate when a change from the presence to the absence of the first signal is identified.

The gutter cover may comprise a control box which encloses the motor and the control unit, and supports the rain sensor, wherein the control box is configured to be fixed to the gutter and be supported by the gutter.

In yet a further variant, the gutter cover comprises a rain sensor. The rain sensor comprises a relay between a power source and the motor, the relay being open when moisture is below a predetermined level and closed when moisture is above the predetermined level. When moisture is above the predetermined level, the closed relay enables passage of electrical power to the motor and activates the motor to move the retractable plate to the extended configuration. When moisture is below the predetermined level, the open relay prevents the passage of electrical power to the motor and deactivates the motor, such that no torque is applied on the shaft by the motor.

Another aspect of some embodiments of the present invention relates to a gutter cover configured to cover a gutter joined to a fascia of a roof, the gutter cover comprising an upper hood panel, a lower cover panel, and a retractable plate. The upper hood panel is configured to be joined to an inclined roof sheathing covering rafters of a roof, to extend above a gutter joined to a fascia joined to the roof rafters, and to no more than partially shield the gutter from above. The lower cover panel is configured to be joined to the gutter and to cover the gutter, such that a gap is present between the upper hood plate and the lower cover panel. The retractable plate is located above the lower cover plate, and configured to be movable between a retracted configuration and an extended configuration. The retractable plate comprises a rear portion and forward flap hinged to the rear portion. In the retracted configuration, the retractable plate is at least partially retracted within the gap and is at least partially shielded by the upper hood panel from above, and the forward flap extends forward from rear plate. In the extended configuration, the retractable plate is at least partially located outside the gap and covers at least most of a forward portion of the lower cover panel, the forward portion of the lower cover panel being a portion that is not shielded by the upper hood panel. In the extended configuration, the forward flap rises upward from a forward edge of the rear portion. The lower cover panel has first openings to enable passage of rainwater from the lower cover plate into the gutter. The retractable plate has second openings, to enable passage of rainwater from the retractable plate to the lower cover panel.

In a variant, in the extended configuration, the forward flap slopes upward and forward at an obtuse angle from the rear portion.

In another variant, the lower cover panel comprises a forward trough having a lip which is configured to be joined to a rim on the front end of the gutter. The first openings comprise a set of first front openings on the front trough. The second openings comprise a set of second front openings which align with the front trough of the lower cover panel when the retractable plate is in the extended configuration, such that rainwater is led from the retractable plate into the front trough via the second front openings and is led from the front trough into the gutter via the first front openings.

In yet another variant, the lower cover panel further comprises a rear trough located between the forward trough and a rear end of the lower cover. The first openings comprise a set of first rear openings on the rear trough. The second openings comprise a set of second rear openings which align with the rear trough of the lower cover panel when the retractable plate is in the extended configuration, such that rainwater is led from the retractable plate into the rear trough via the second rear openings and is led from the rear trough into the gutter via the first rear openings.

In some embodiments of the present invention, the gutter cover, further comprises a motor, a circular gear, and a track. The motor comprises a shaft and is configured to rotate the shaft about a longitudinal axis of the shaft, the motor being configured to be fixed to at least one of: the gutter, the upper hood panel, and the lower cover panel. The circular gear is joined concentrically to the shaft and configured to rotate with the shaft. The track is joined to a lateral side of the retractable plate and configured to mesh with the circular gear, such that rotation of the circular gear moves the track and thereby linearly moves the retractable plate to which the track is joined at least from the retracted configuration to extended configuration.

In a variant, the gutter cover comprises a solar panel configured to generate electricity to power the motor.

In another variant, the gutter cover comprises a spiral spring wound about the shaft with a first end joined to the shaft and a second end joined to a fixed location. The spiral spring is configured to tighten about the shaft as the shaft rotates to move the retractable plate from the retracted configuration to the extended configuration, when the motor stops rotation of the shaft, the motor stops applying torque to the shaft and the spiral spring is configured to unwind and thereby rotate the shaft to move the retractable plate from the extended configuration to the retracted configuration.

In yet another variant, the gutter cover comprises a spring having a first end joined to the retractable plate and a second end joined to the any part of the roof or the upper hood panel or lower hood panel. The spring is configured to extend when the retractable plate is moved from the retracted configuration to the extended configuration. When the motor stops rotation of the shaft, the motor stops applying torque to the shaft and the spring is configured to return to an equilibrium length thereof, thereby pulling the retractable plate from the extended configuration to the retracted configuration.

In a further variant, the gutter cover comprises a rain sensor and a control unit in communication with the motor. The rain sensor is configured to detect rainfall, and to generate a first signal when rainfall is detected. The control unit is configured to receive the first signal, identify a change between absence and presence of the first signal, and to control the motor to extend the retractable plate when a change from absence to presence of the first signal is identified and to retract the retractable plate when a change from presence to absence of the first signal is identified.

The gutter cover may comprise a control box which encloses the motor and the control unit, and supports the rain sensor, wherein the control box is configured to be fixed to the gutter and be supported by the gutter.

In yet a further variant, the gutter cover comprises a rain sensor. The rain sensor comprises a relay between a power source and the motor, the relay being open when moisture is below a predetermined level and closed when moisture is above the predetermined level. When moisture is above the predetermined level, the closed relay enables passage of electrical power to the motor and activates the motor to move the retractable plate to the extended configuration. When moisture is below the predetermined level, the open relay prevents the passage of electrical power to the motor and deactivates the motor, such that no torque is applied on the shaft by the motor.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
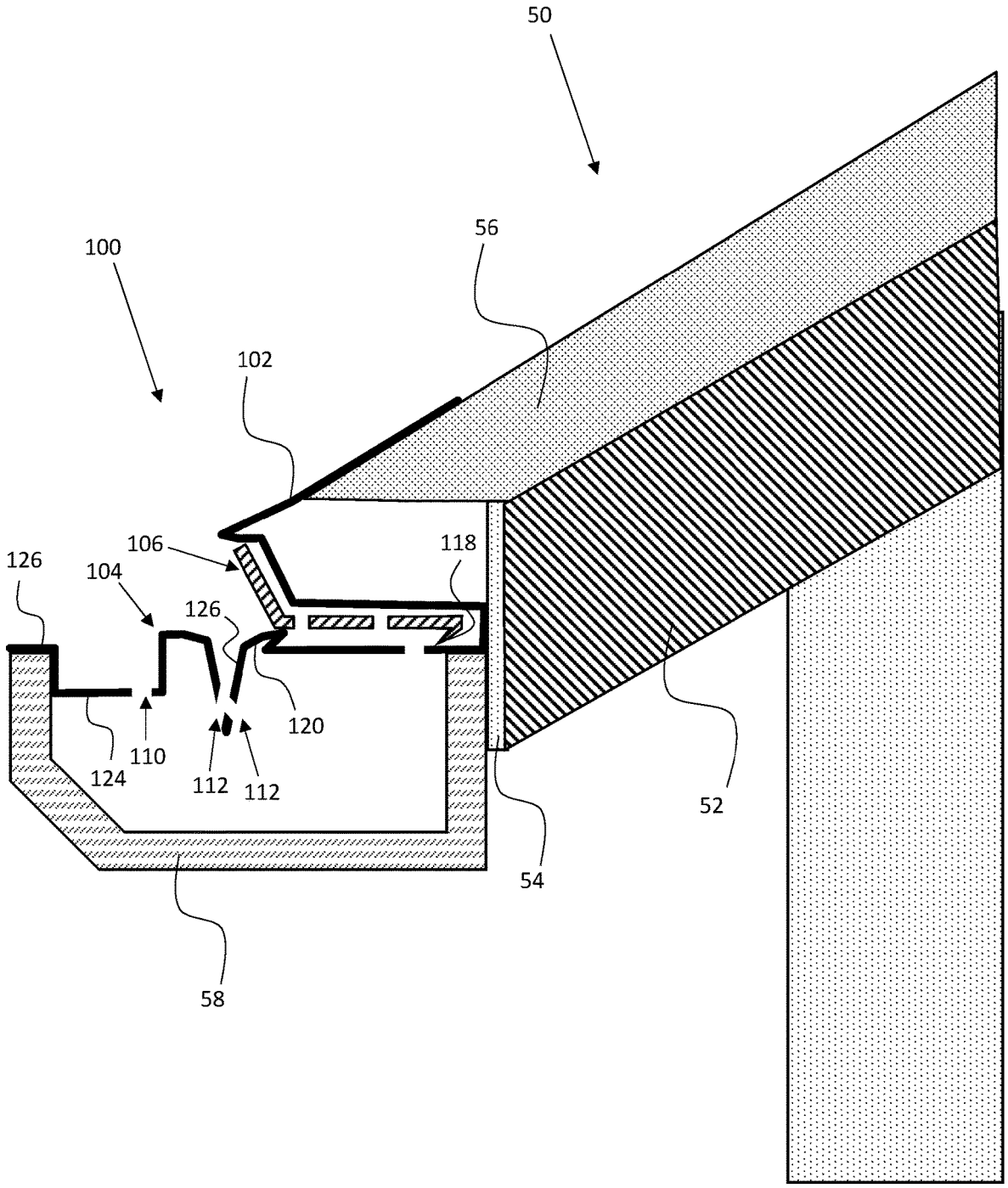
FIG. 1 is a side view of a gutter cover with a retractable plate retracted, according to some embodiments of the present invention.
Figure 2:
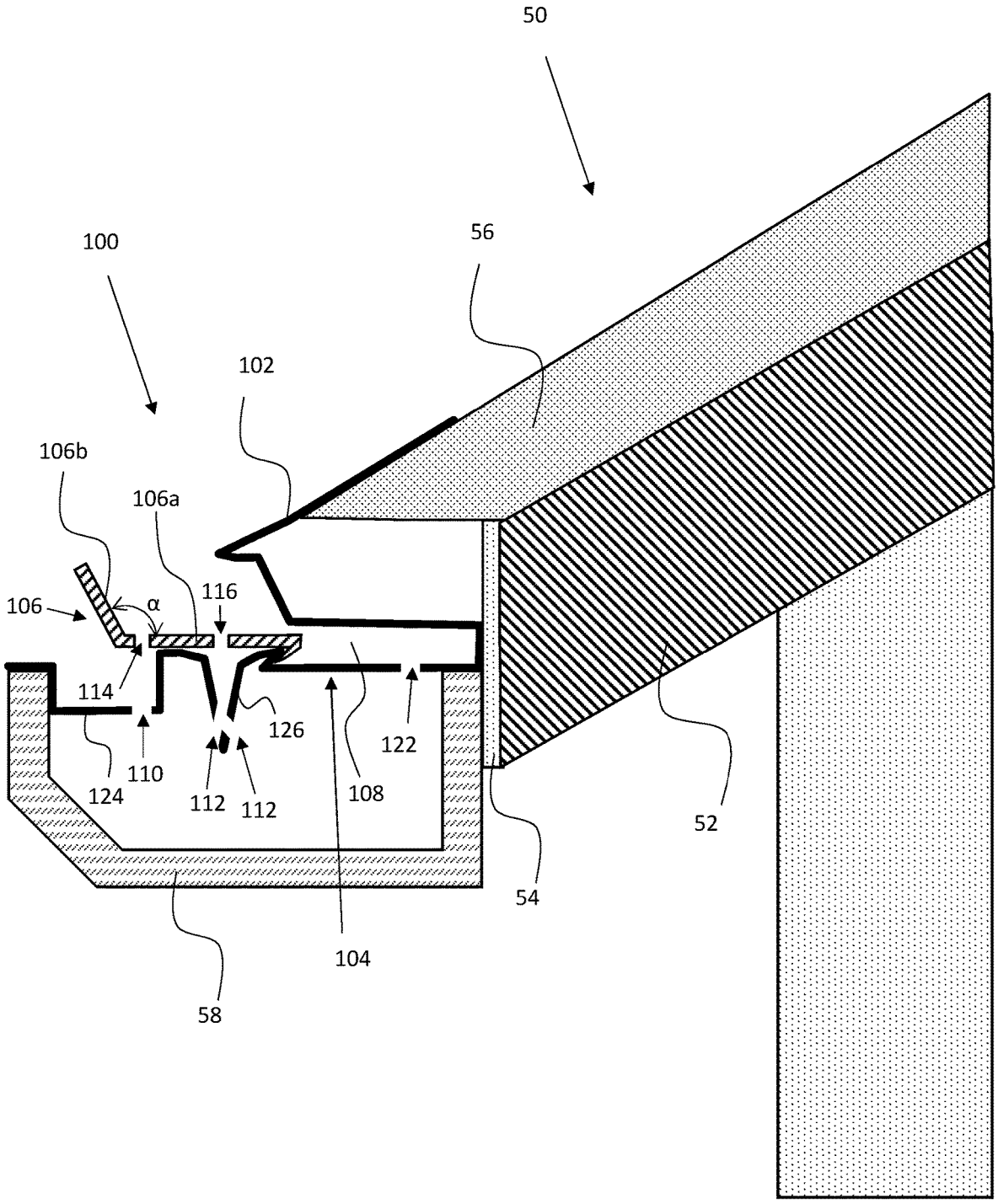
FIG. 2 is a side view of a gutter cover with a retractable plate extended, according to some embodiments of the present invention.
Figure 3:
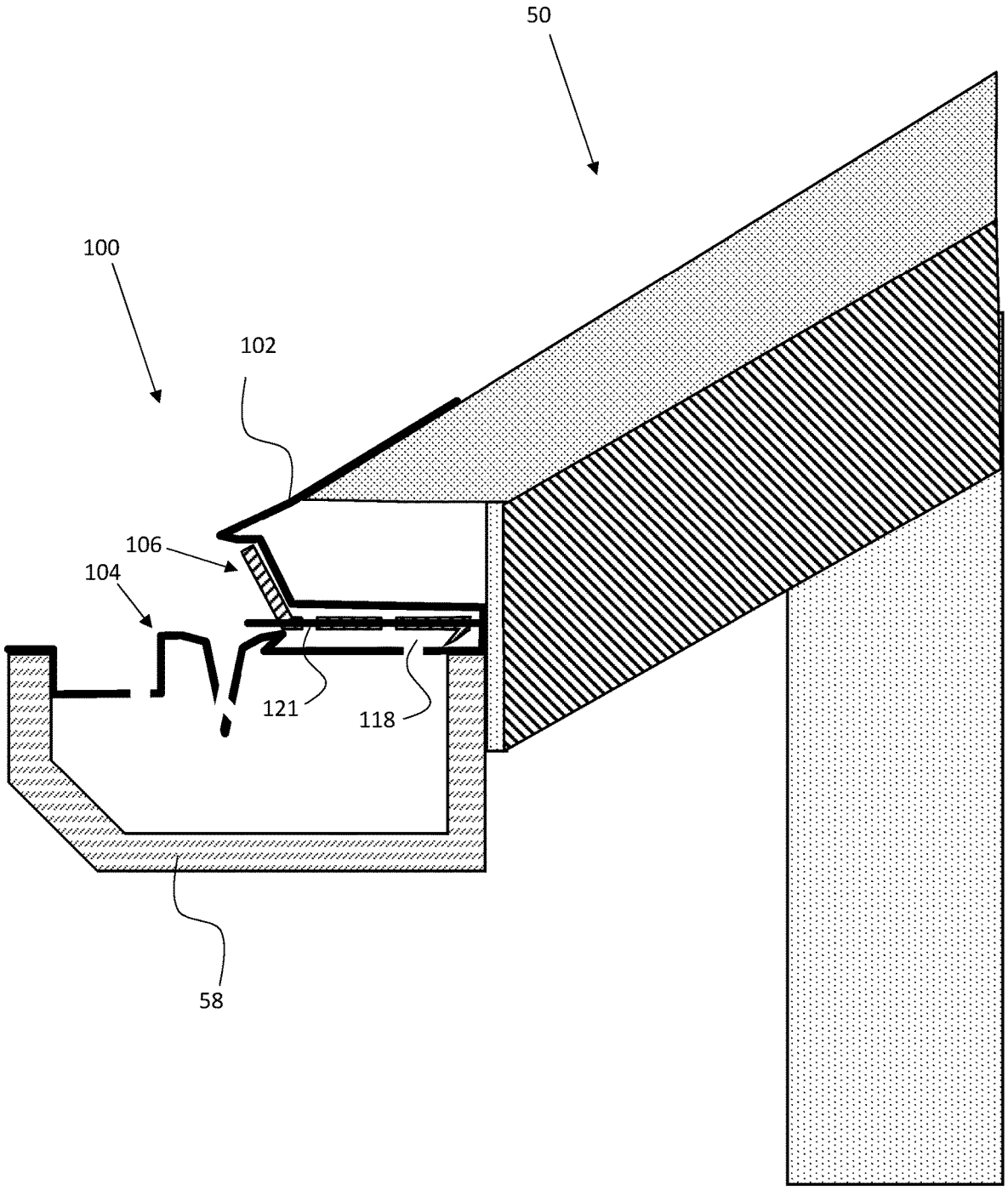
FIG. 3 is a side view of a gutter cover with a retractable plate retracted, where the gutter cover includes a support body for the retractable plate, according to some embodiments of the present invention.
Figure 4:
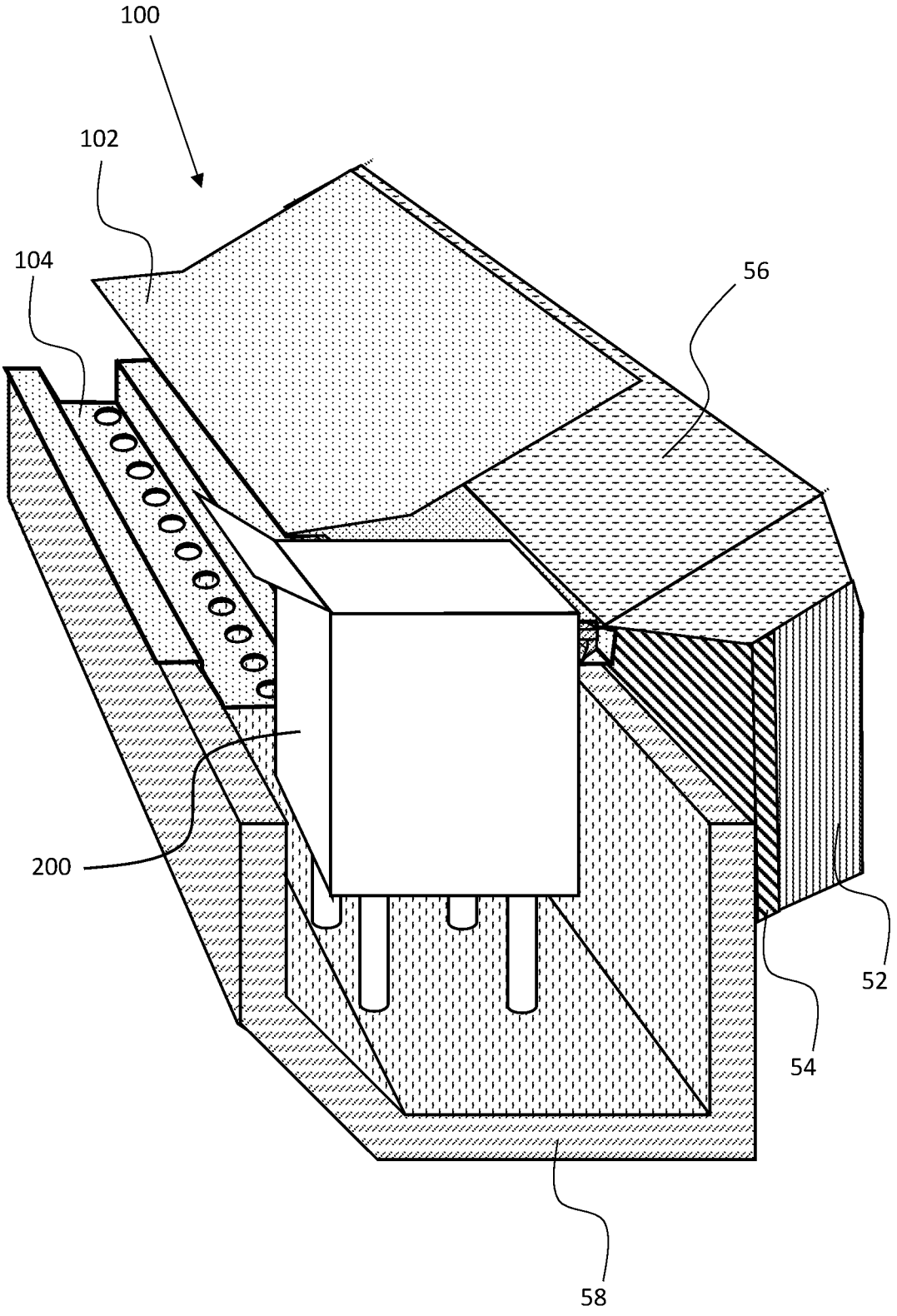
FIG. 4 is a perspective view of a gutter cover with a retractable plate retracted, according to some embodiments of the present invention.
Figure 5:
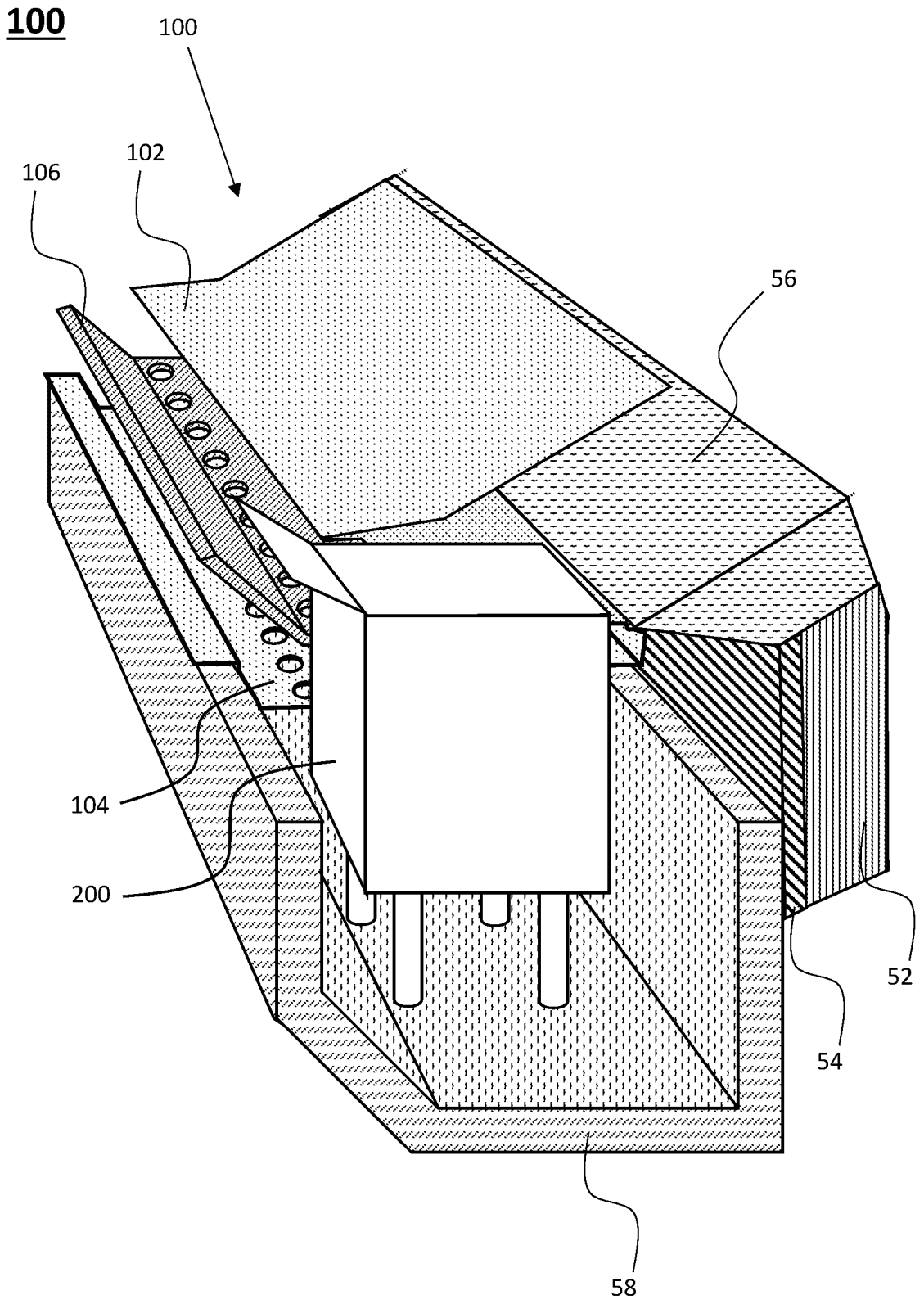
FIG. 5 is a perspective view of a gutter cover with a retractable plate extended, according to some embodiments of the present invention.

Referring now to the drawings, FIG. 1 is a side view of a gutter cover 100 with a retractable plate retracted, according to some embodiments of the present invention. FIG. 2 is a side view of the gutter cover 100 with a retractable plate extended, according to some embodiments of the present invention. FIG. 3 is a side view of a gutter cover with a retractable plate retracted, where the gutter cover includes a support body for the retractable plate, according to some embodiments of the present invention. FIG. 4 is a perspective view of the gutter cover 100 with a retractable plate retracted, according to some embodiments of the present invention. FIG. 5 is a perspective view of the gutter cover 100 with a retractable plate extended, according to some embodiments of the present invention.

Before describing the gutter cover of the present invention, the structure of the roof and the gutter will be described. It should be noted that the roof and gutter are not part of the invention. The roof 50 includes a plurality of spaced-apart rafters 52. The fronts of the rafters 52 are covered by a fascia 54 extending to cover the plurality of spaced apart rafters. The tops of the rafters 54 are inclined and covered by a roof sheathing 56. The roof sheathing may be covered by an outer layer, such as metal roofing or shingle roofing. The gutter 58 is trough-shaped, joined to the fascia, and extends forward from the fascia ahead of the roof sheathing. In this manner, rainwater sliding down the inclined roof is captured by the gutter 58 and discharged via a down pipe (not illustrated). As noted above, rainwater may gain enough speed as the rainwater moves along the inclined roof to bypass the gutter 58.

The gutter cover 100 is configured to cover the gutter 58, and includes an upper hood panel 102, a lower cover panel 104, and a retractable plate 106.

The upper hood panel 102 is configured to be joined to the inclined roof sheathing 56, extends above the gutter 58, and is configured to no more than partially shield the gutter 58 from above. The lower cover panel 104 is configured to be joined to the gutter 58 and to cover the gutter 58, such that a gap 108 is present between the upper hood plate 102 and the lower cover panel 104. The retractable plate 106 is located above the lower cover plate 104, and is configured to be movable between a retracted configuration and an extended configuration.

The retractable plate includes a rear portion 106*a* and forward flap 106*b*. The forward flap 106*b* slopes upward from a forward edge of the rear portion 106*a*. In the retracted configuration (FIGS. 1 and 3), the retractable plate 106 is retracted within the gap 108 and is shielded by the upper hood panel 102 from above. In the extended configuration (FIGS. 2 and 4), the retractable plate 106 is at least partially located outside the gap 108 and covers at least most of a forward portion of the lower cover panel 104, i.e., a portion of the lower cover panel 104 that is not shielded by the upper hood panel 102.

The lower cover panel 104 has first openings (110, 112) to enable passage of water from the lower cover plate 104 into the gutter 58. The retractable plate 106 has second openings (114, 116), to enable passage of from the retractable plate 106 to the lower cover panel 104.

The retractable plate 106 is configured to be in the retracted configuration and to remain fully covered by the upper hood panel 102 when rainfall is not detected.

The retractable plate 106 is configured to be in the extended configuration when rainfall is detected. If the retractable plate 106 remained retracted at during rainfall, it is possible that the speed of the rainwater sliding down the inclined roof and over the top of the upper hood panel would be high enough to leap over the gutter and fall onto undesirable locations. When the retractable plate 106 is extended, the forward flap sloping upwards forms a barrier above the gutter that stops and captures at least some of the water that would otherwise leap over the gutter. The captured water is led from the retractable plate 106 onto the lower cover panel via the second openings (114, 116), and then into the gutter via the first openings (110, 112).

In some embodiments of the present invention, an extension 118 protrudes under the retractable plate 106, at the rear of the retractable plate 106, and a hem 120 is formed on a lower cover panel 104. The extension 118 and is caught by the hem 120 to stop the forward motion of the retractable plate 106 and prevent the retractable plate from moving too far and falling from the lower cover panel 104.

In some embodiments of the present invention, the bottom cover panel 104 has one or more elevated portions configured to provide support to the retractable plate 106. In other embodiments of the present invention, a support body 121 extends in the gap 108 above the bottom cover panel 104 to support the retractable plate 106, as seen in the example of FIG. 3. The support body may include, for example, a plurality of spaced-apart rods of panels extending forward with the gap.

In some embodiments of the present invention, the forward flap 106*b* slopes upward and forward at an obtuse angle $\alpha$ from the rear portion. In this manner, rainwater flowing from the top roof is caught and stopped by the forward flap 106*b*, and slides rearwards on the forward flap and more easily reaches the second apertures 114 and 116. In a non-limiting example, the angle $\alpha$ may be 120-160 degrees. In another example, the angle $\alpha$ may be about 135 degrees (±15%).

In some embodiments of the present invention, at least some of the second openings (114, 116) of the retractable plate 106 align with at least some of the first openings (110, 112) of the lower cover panel when the retractable plate is in the extended configuration. In this manner, the fall of the water from the retractable plate into the gutter occurs more quickly, decreasing the chances of water building up on the lower cover panel 104 and spilling outwards.

In some embodiments of the present invention, the lower cover panel 104 has a hind opening 122 opening behind the hem and at a location that remains behind the retractable plate 106 when the retractable plate 106 is in the extended configuration. In this manner, in case some of the rainwater captured by the retractable plate flows over and the second openings (114, 116) and falls onto the lower cover panel behind the retractable plate 106, at least some of that water still is led into the gutter via the hind opening 112.

The lower cover panel 104 may be to cover the gutter from a rear end of the gutter joined to the fascia 54 to a front end of the gutter.

In some embodiments of the present invention, the lower cover panel 104 comprises a forward trough 124 having a lip 126, which is configured to be joined to a rim on the front end of the gutter 58. The forward trough extends below the level of the gutter's rim. The lip 126 may have an opening for receiving a screw, nail, bolt, or other retaining unit, to be driven into the rim of the gutter 58, thereby securing the lower cover panel 104 to the trough 58.

The first openings on the lower cover panel 104 comprise a set of first front openings 110 on the front trough. The second openings on the retractable plate 106 include a set of second front openings 114 which align with the front trough 124 of the lower cover panel 104 when the retractable plate 106 is in the extended configuration, as seen in FIG. 2. In this manner, water is led from the retractable plate 106 into the front trough 124 via the second front openings 114 and is led from the front trough 124 into the gutter 48 via the first front openings 110.

In some embodiments of the present invention, the lower cover panel 104 further comprises a rear trough 126 located between the forward trough 124 and a rear end of the lower cover 104. The first openings of the lower cover panel 104 include a set of first rear openings 112 on the rear trough 126.

The second openings on the retractable plate 106 include a set of second rear openings 116 which align with the rear trough 126 when the retractable plate 106 is in the extended configuration. In this manner, water is led from the retractable plate 106 into the rear trough 126 via the second rear openings 116, and is led from the rear trough 126 into the gutter 58 via the first rear openings 112.

In some embodiments of the present invention, the retractable plate 106 is configured to be moved by a motor. The motor may be part of the gutter cover 100, or may be associated with the gutter cover 100. The motor may be powered a solar panel and may be controlled by a rain sensor, as will be discussed further below. In some embodiments of the present invention, the motor is enclosed in a control box 200 which encloses the motor and the control unit (which controls the motor). The control box 200 is configured to be fixed to the upper hood panel, and/or to the lower cover panel and/or the gutter 58. The control box 200 may configured to be placed on a location of the gutter which is not covered by the gutter cover 100, so that the control box 200 is on lateral side of the retractable plate 106.

Figure 6:
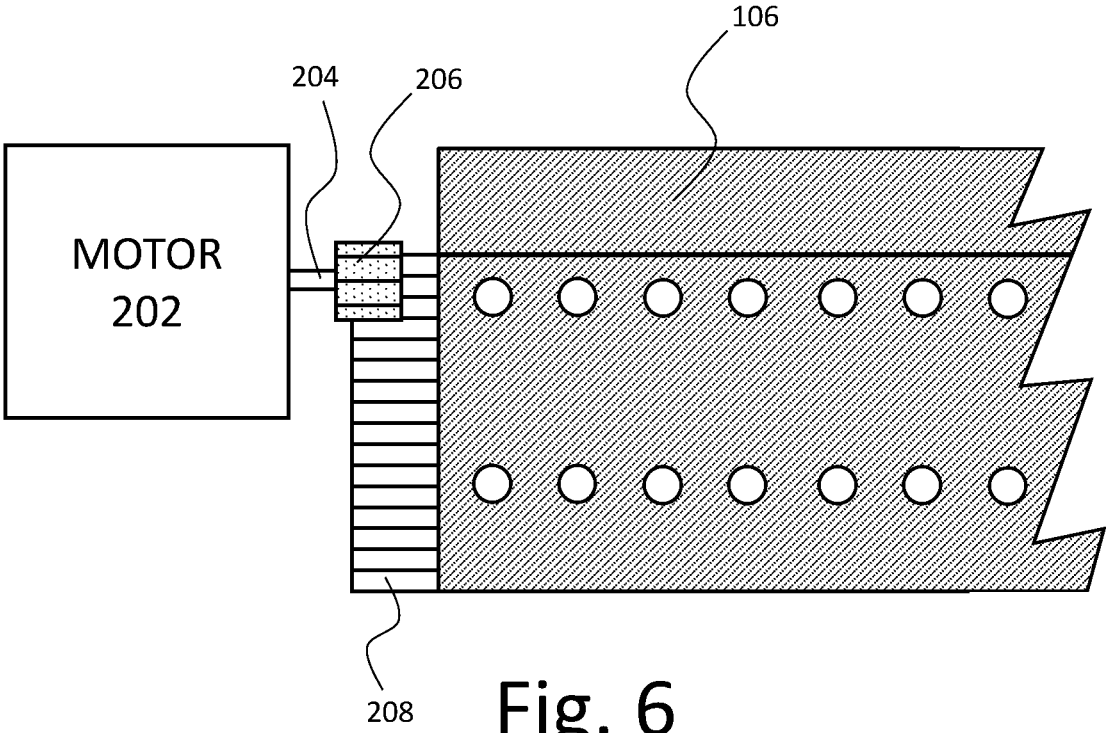
FIGS. 6 and 7 are top views of a motor and a retractable plate, showing a rack and pinion mechanism that moves the retractable plate between a retracted position (FIG. 6) and an extended position (FIG. 7), according to some embodiments of the present invention.
Figure 7:
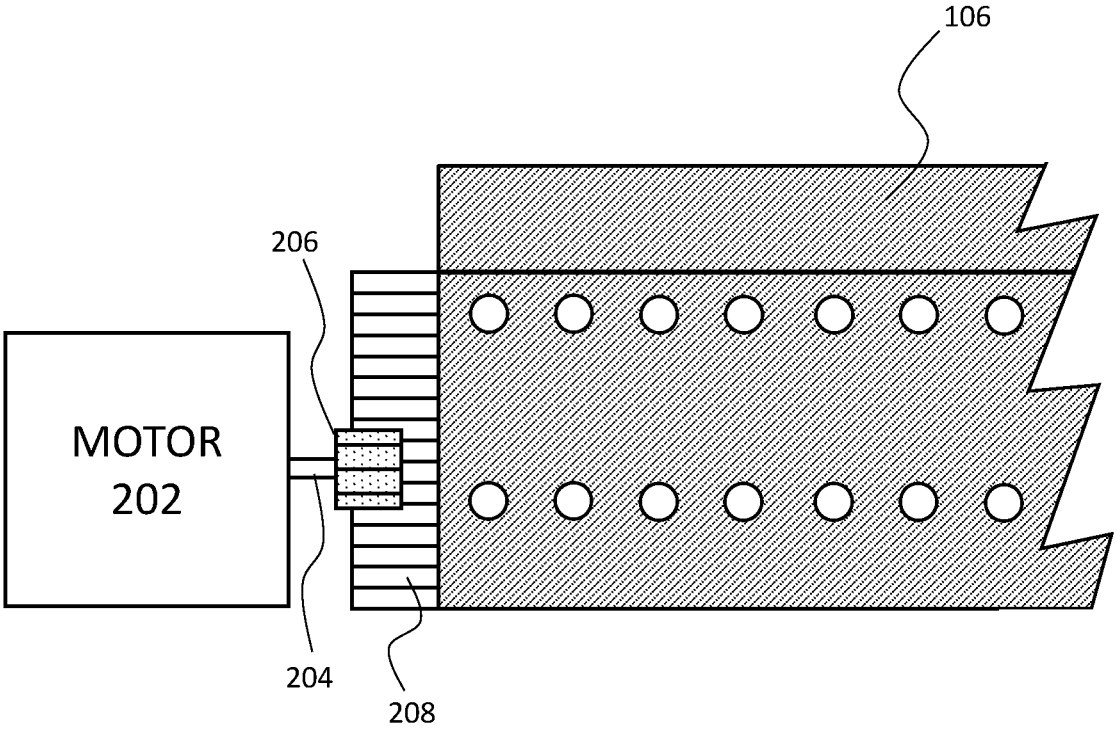
Figure 8:
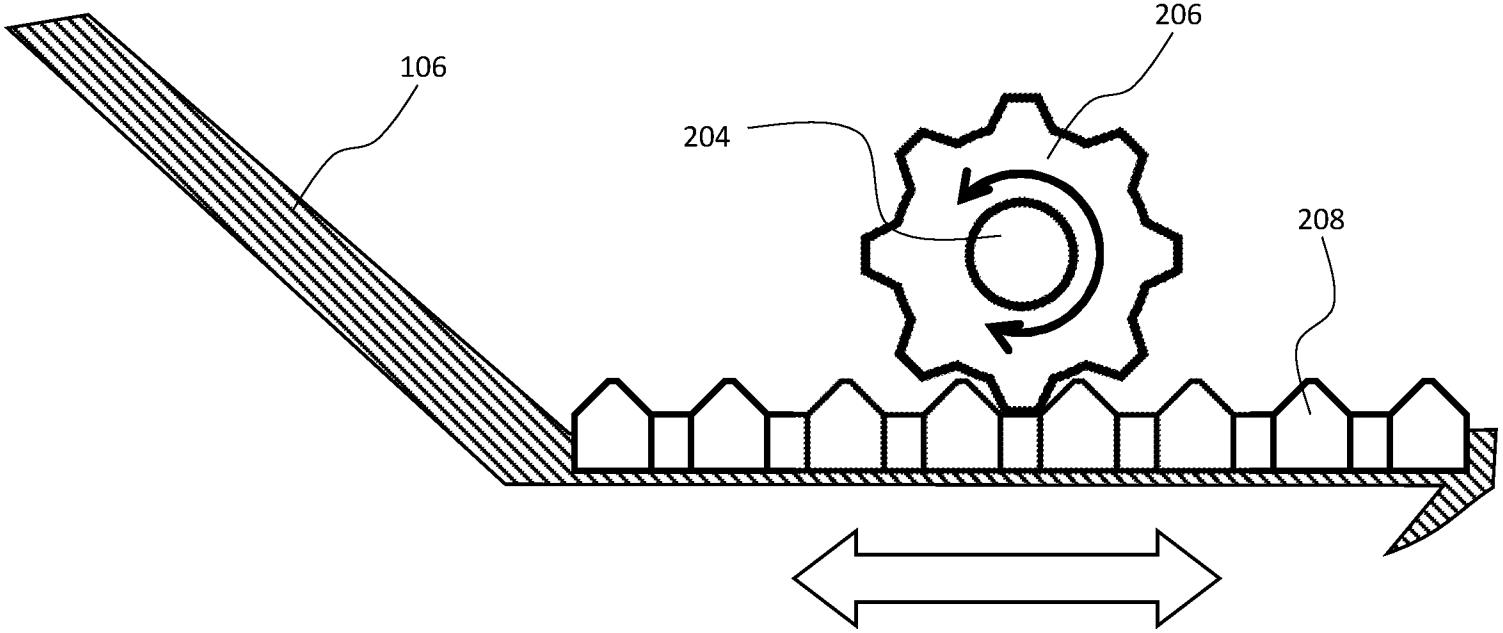
FIG. 8 is a side view of the rack and pinion mechanism of FIGS. 6 and 7, according to some embodiments of the present invention.

FIGS. 6 and 7 are top views of a motor 202 and a retractable plate 106, showing a rack and pinion mechanism that moves the retractable plate between a retracted position (FIG. 6) and an extended position (FIG. 7), according to some embodiments of the present invention. FIG. 8 is a side view of the rack and pinion mechanism of FIGS. 6 and 7, according to some embodiments of the present invention.

The motor 202 includes a shaft 204 and is configured to rotate the shaft both clockwise and counterclockwise about a longitudinal axis of the shaft 204. The motor 202 is configured to be fixed to at least one of: the gutter, the upper hood panel, and the lower cover panel. A circular gear 206 joined concentrically to the shaft and configured to rotate with the shaft 204. A linear track 208 joined to a lateral side of the retractable plate 106 and is configured to mesh with the circular gear 206, such that rotation of the circular gear 206 moves the track 208 and thereby linearly moves the retractable plate 106 to which the track 208 is joined between the retracted configuration (FIG. 6) and the extended configuration (FIG. 7).

Figure 9:
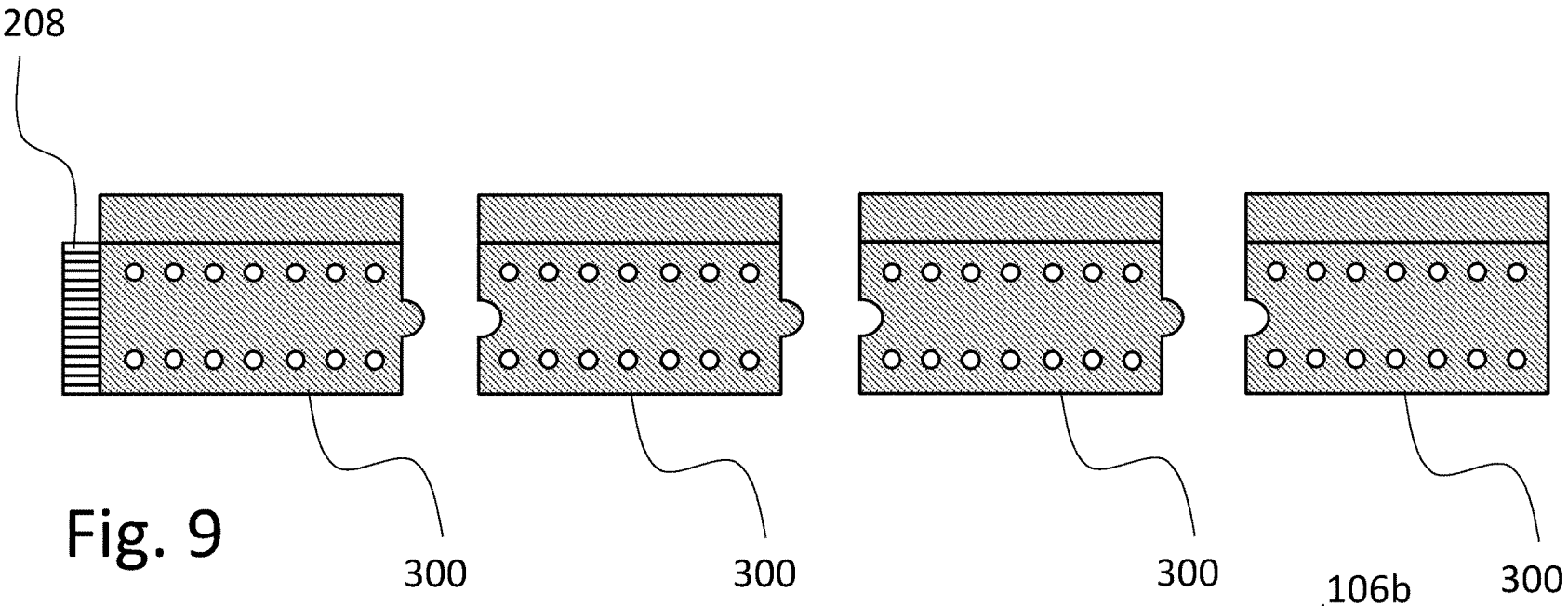
FIG. 9 is an exploded top view of a modular retractable plate with a track on a single lateral side thereof, according to some embodiments of the present invention.
Figure 10:
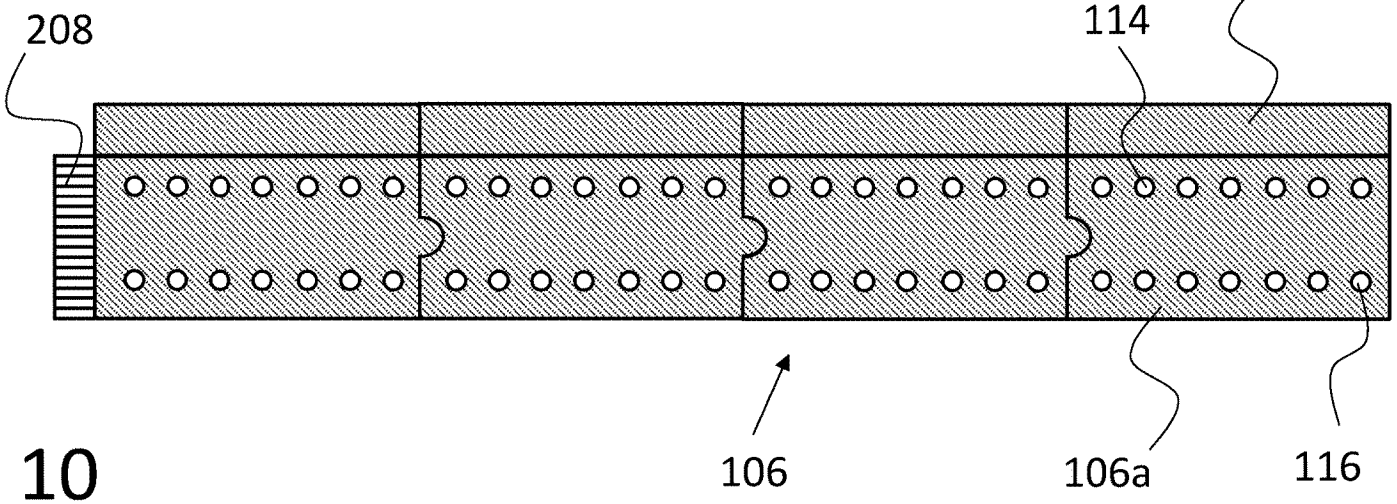
FIG. 10 is a top view of the modular retractable plate of FIG. 9, with all the plate's sections connected, according to some embodiments of the present invention.
Figure 11:
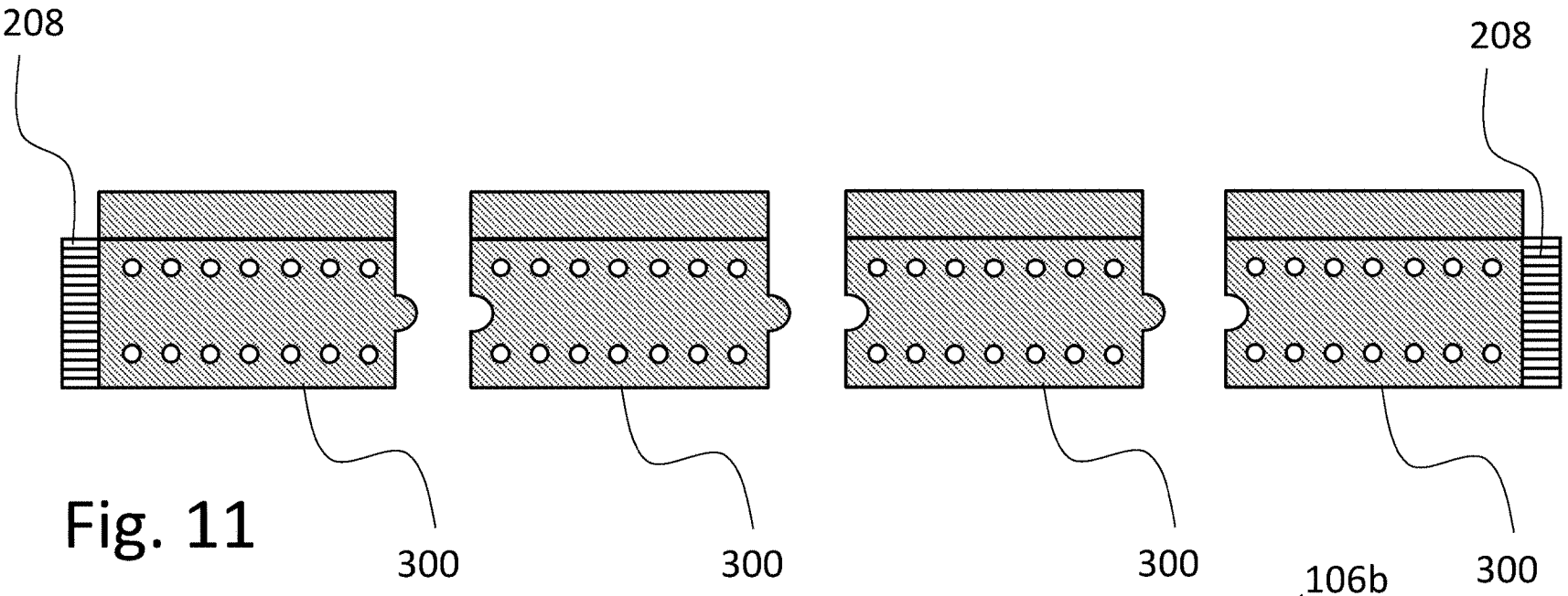
FIG. 11 is an exploded top view of a modular retractable plate with tracks on both lateral sides thereof, according to some embodiments of the present invention.
Figure 12:
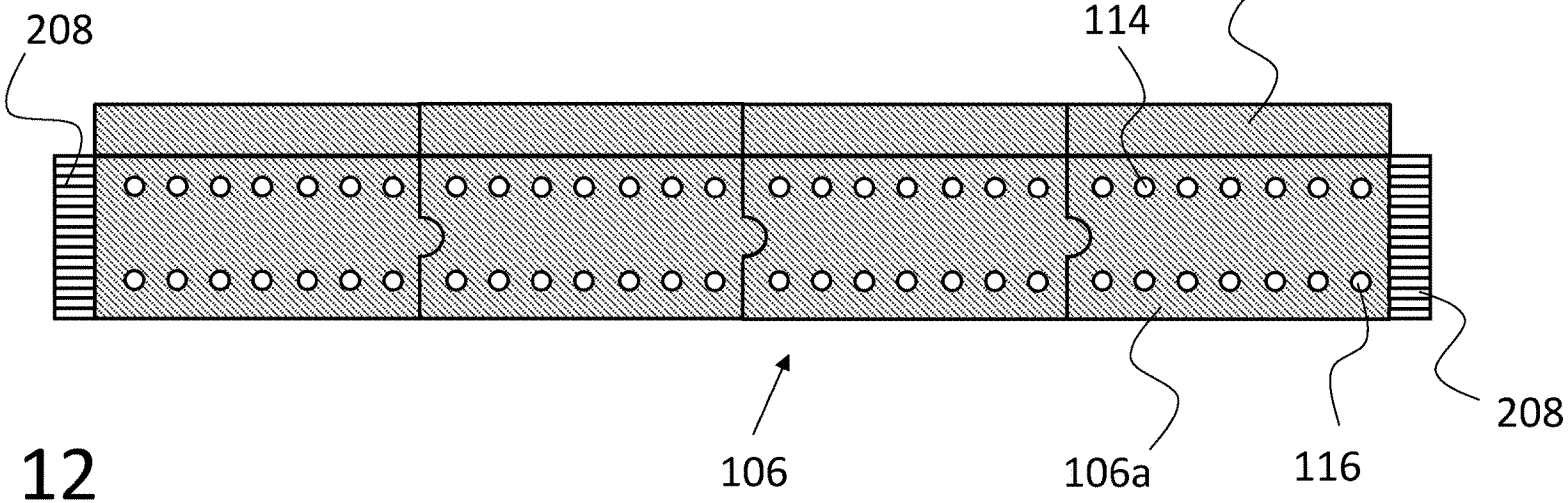
FIG. 12 is a top view of the modular retractable plate of FIG. 11, with all the plate's sections connected, according to some embodiments of the present invention.

FIG. 9 is an exploded top view of a modular retractable plate with a track on a single lateral side thereof, according to some embodiments of the present invention. FIG. 10 is a top view of the modular retractable plate of FIG. 9, with all the plate's modules connected, according to some embodiments of the present invention. FIG. 11 is an exploded top view of a modular retractable plate with tracks on both lateral sides thereof, according to some embodiments of the present invention. FIG. 12 is a top view of the modular retractable plate of FIG. 11, with all the plate's modules connected, according to some embodiments of the present invention.

In some embodiments of the present invention, the retractable plate 106 is made of a plurality of modules 300. Each module 300 includes a portion of the second openings 114, 116, a section of the rear portion 106*a* and a section of the forward flap 106*b*. Each module 300 is configured to cooperate with and join to modules on either side.

In the example of FIGS. 9 and 10, only one module 300 includes a track 208, so that the rack-and-pinion mechanism moves the track and all the modules 300 that join together to form the retractable plate 106. In the example of FIGS. 11 and 12, both end modules incudes respective tracks 208, each track being configured to be meshed with a respective circular gear of a respective motor. This is advantageous for long retractable plates, and the modular plate is actuated from both sides simultaneously, thereby distributing the force more evenly and lowering the risk of the modules separating while actuated from a single end of the retractable plate.

Figure 13:
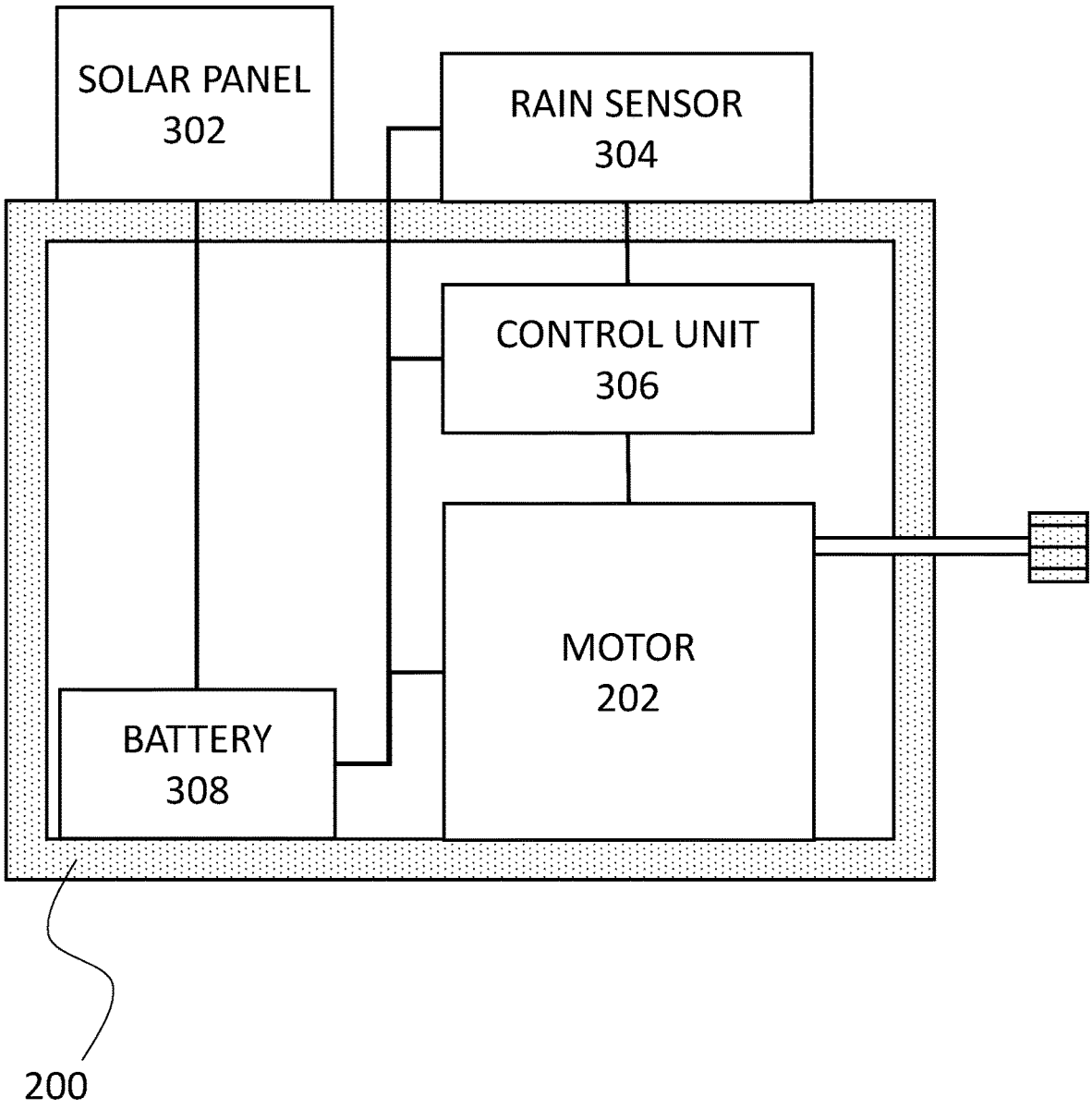
FIGS. 13 and 14 are block diagram of an actuator box configured to move the retractable plate, according to some embodiments of the present invention.
Figure 14:
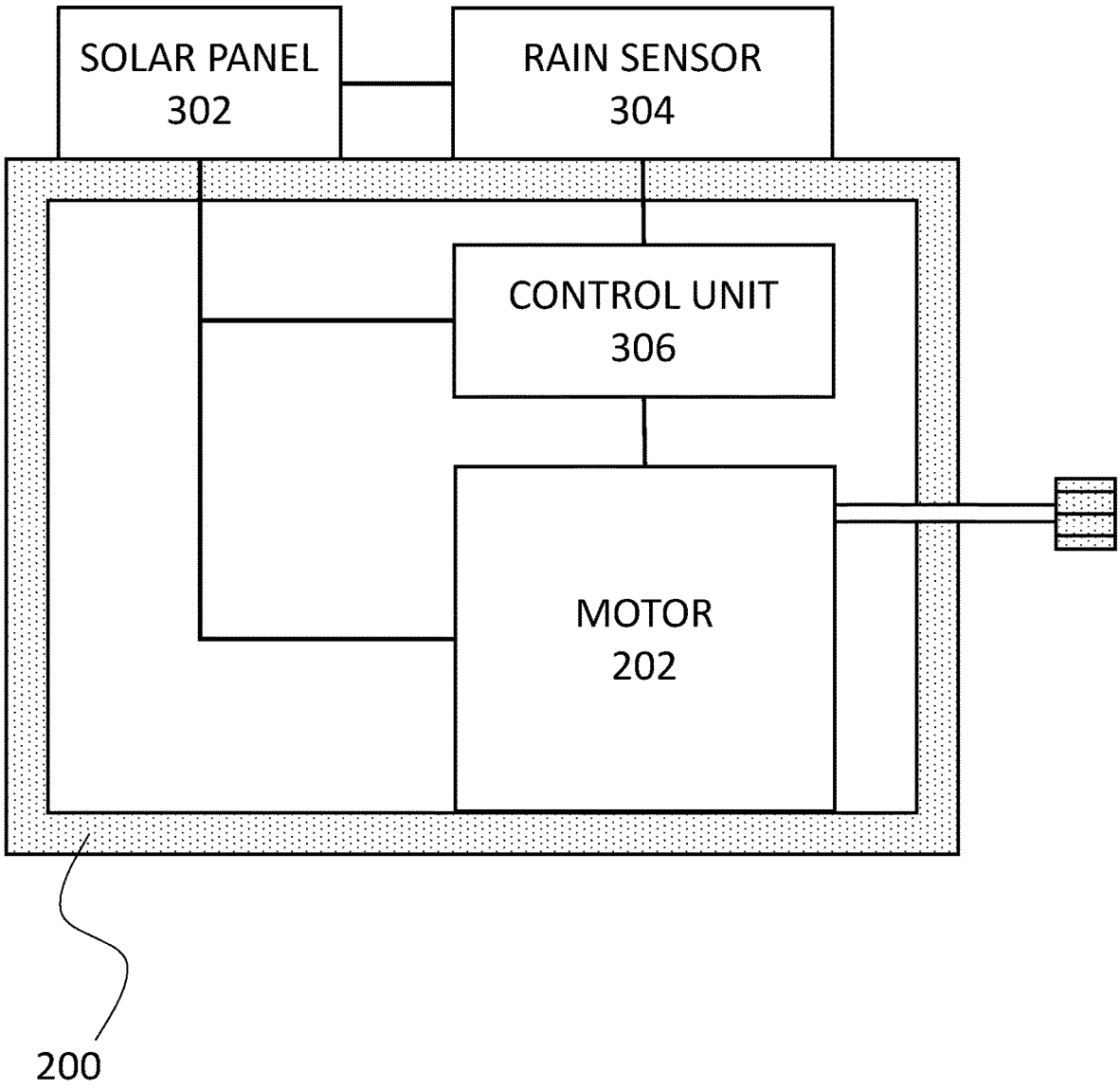

FIGS. 13 and 14 are block diagrams of an actuator box 200 configured to move the retractable plate, according to some embodiments of the present invention.

In some embodiments of the present invention, the motor 202 is powered by a solar panel 302 configured to generate electricity to power the motor.

In some embodiments of the present invention, a rain sensor 304 is present and in communication with the motor 202.

The rain sensor 304 is configured to control the motor 202 to move the retractable plate into its extended position/configuration when a change from the absence to the presence of rain is identified, and to cause the retraction of the retractable plate into the retracted position/configuration when a change from the presence to the absence of rain is identified.

In some embodiments of the present invention, the rain sensor 304 is a moisture detector. Moisture above a certain level (which is indicative of the presence of rain) closes a normally open relay and powers the motor, causing the motor to turn the shaft in a first direction to drive out the retractable plate to the extended configuration. A stopping unit stops the motion of retractable plate at the extended configuration, even as the motor is powered and attempts to turn the shaft. For example, the hem 120 on the lower cover panel 104 catches the extension 118 of the retractable plate 106 to stop the forward motion of the retractable plate, as shown in FIG. 2.

The retractable plate or the shaft motor may be spring loaded. Therefore, once the rain sensor senses no moisture or moisture below a predetermined level (indicative of a stop in the rain), the relay is opened again, and power to the motor drops, stopping the torque applied by the motor on the shaft. With no torque applied by the motor to the shaft and no force applied to counter the spring loading, the spring loading pulls the on the shaft or causes the shaft to turn in a second direction (opposite to the first direction), or directly pulls the retractable plate backwards, thereby driving the retractable plate back into the retracted configuration.

In some embodiments of the present invention, the rain detector detects rain, for example via detecting the presence of moisture, and generates a first signal when rain is detected. A control unit 306 may be present and configured to receive the first signal, identify a change between absence and presence of the first signal (indicating a change between a condition of no rain and a condition of rain), and to control the motor 202 to turn the shaft in a first direction to move the retractable plate forward to the extended configuration when a change from the absence to the presence of rain is identified, and to turn the shaft in the opposite direction to move the retractable plate into the retracted configuration when a change from the presence to the absence of rain is identified. In some embodiments of the present invention, the activation of the motor in response to the change between absence and presence of the first signal is not constant, rather temporary. More specifically, the motor may be activated for a predetermined period of time (corresponding to the time it takes to move the retractable plate between the extended configuration and the retracted configuration). In this manner, the motor is activated to move the retractable plate to the retracted configuration or the extended configuration, and then automatically stopped. Thus, the motor is not active when there is no need for the motor to be active.

In some embodiments of the present invention, a control box 200 encloses the motor 202 and the control unit (if present), and supports the rain sensor 304. The control box may be configured to be fixed to the gutter and be supported by the gutter.

The solar panel 302 may be configured to generate electricity to power the motor 202, the control unit 306, and the rain sensor 304. The solar panel may be connected also supported by the control box 200 or may be located remotely and connected to the control unit, rains sensor, and motor.

In a variant, as shown by the example of FIG. 13, a battery 308 is provided, to store electrical power provided by the solar panel 302. The stored electrical power is provided to the motor 202, the control unit 306, and the rain sensor 304 by the battery 302. The battery, if present, may be stored in the control box. Alternatively, as shown by the example of FIG. 14, no battery is present and the solar panel 302 directly provides electrical power to the motor 202, the control unit 306, and the rain sensor 304.

Figure 15:
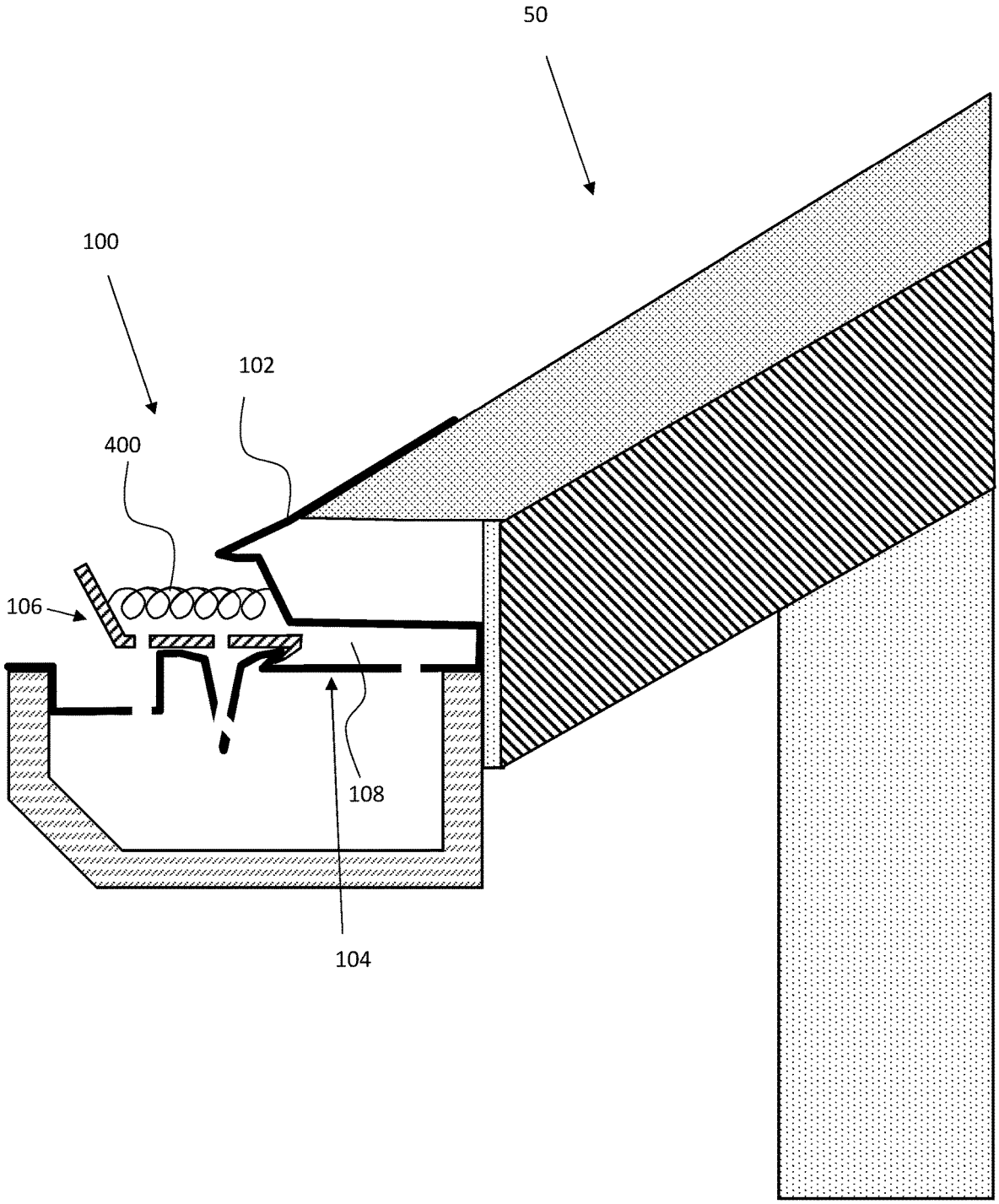
FIG. 15 illustrates an embodiment of the present invention, in which a spring is joined to the retractable plate.

FIG. 15 illustrates an embodiment of the present invention, in which a spring is joined to the retractable plate.

The spring loading may include, for example a spring 400 joining the retractable plate 106 to the any part of the roof 50 or the upper hood panel 102 or lower hood panel 104. The spring 400 is configured to extend as the retractable plate 106 moves from the retracted configuration to the extended configuration. Once power to the motor drops (when there is no rain), the motor stops driving the retractable plate 106 forward and the spring 400 pulls the retractable plate 106 backwards to the retracted configuration.

Figure 16:
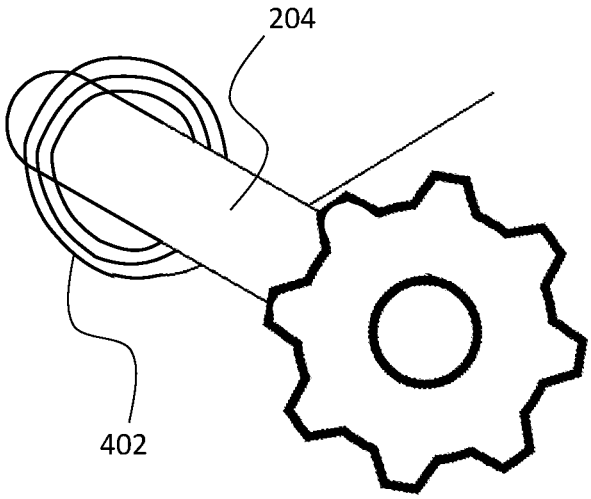
FIGS. 16 and 17 illustrates an embodiment of the present invention, in which a spring is wound around the shaft.
Figure 17:
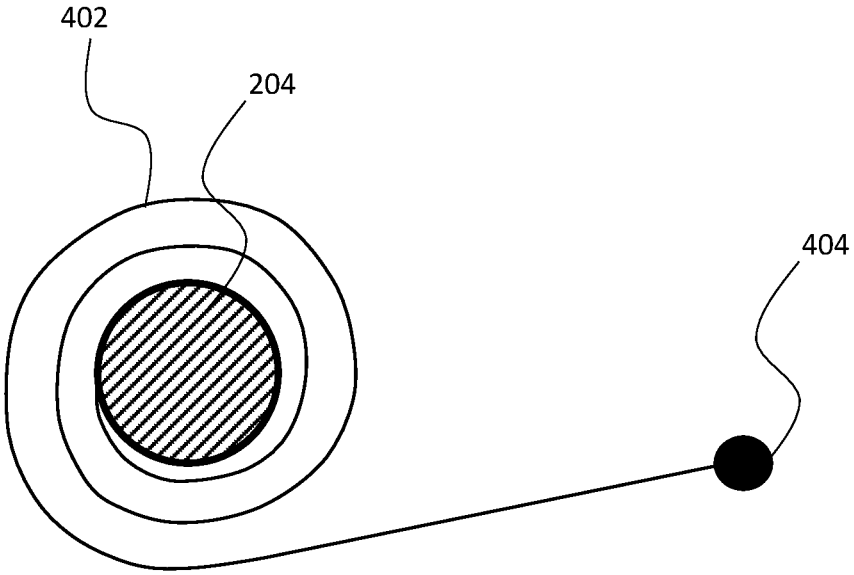

FIGS. 16 and 17 illustrates an embodiment of the present invention, in which a spring is wound around the shaft.

The spring loading may include, for example, a torsion (spiral) spring 402 wound around the shaft 204 with an end joined to the shaft 204 and a second end joined to a fixed location 404. As the shaft 204 is driven by the motor and rotated in a first direction (to move the retractable plate forward), the winding tightens around the shaft 204, compressing the torsion (spiral) spring 402. As power to the motor is cut and the motor stops applying torque on the shaft, the spring 402 unwinds to reach its equilibrium configuration, thereby rotating the shaft 204 in a second direction which is opposite to the first direction and therefore causes the retractable plate to move backwards and return to its retracted configuration.

Figure 18:
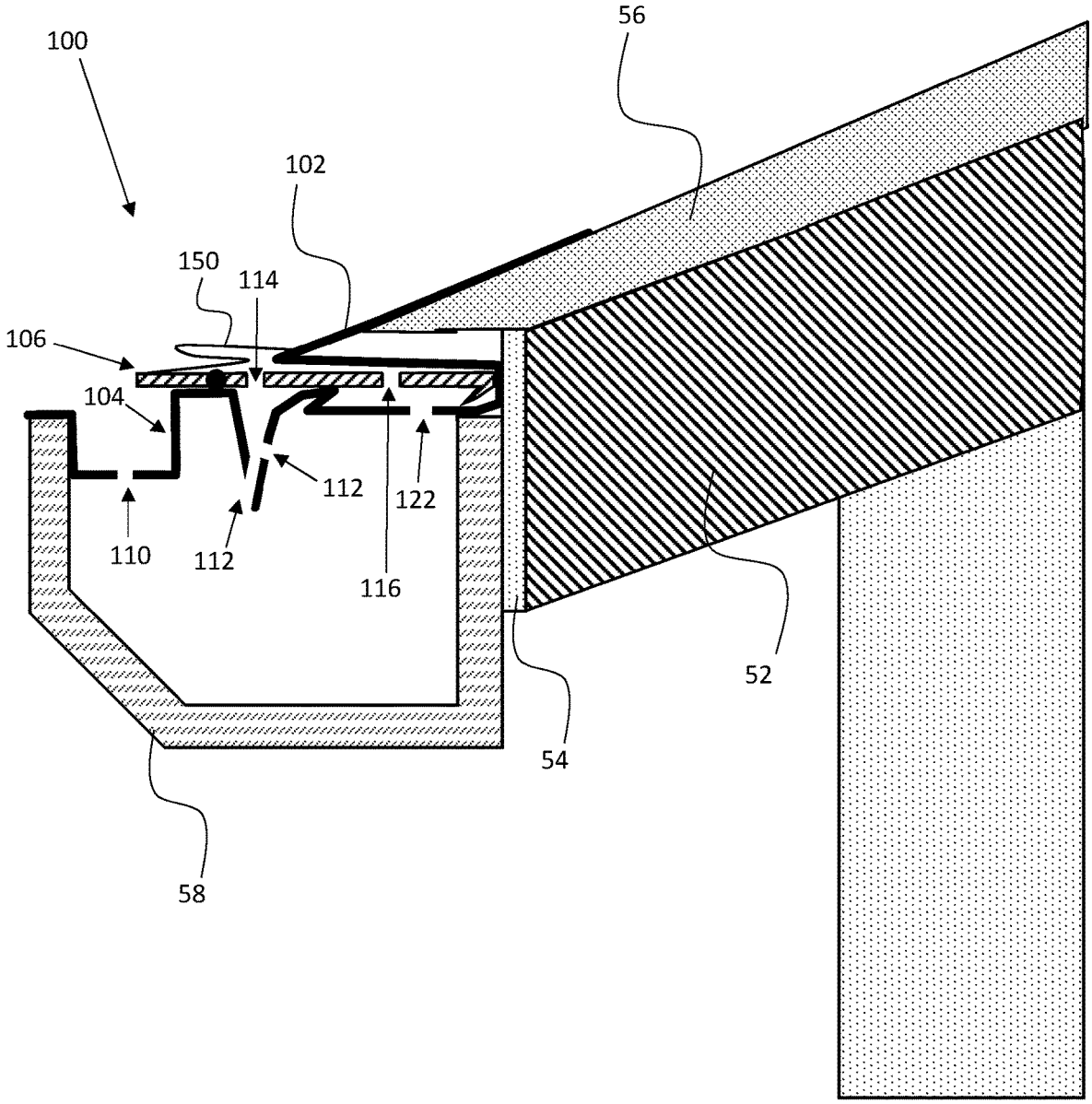
FIG. 18 is a side view of a gutter cover with a retracted retractable plate having a hinged flap, according to some embodiments of the present invention.
Figure 19:
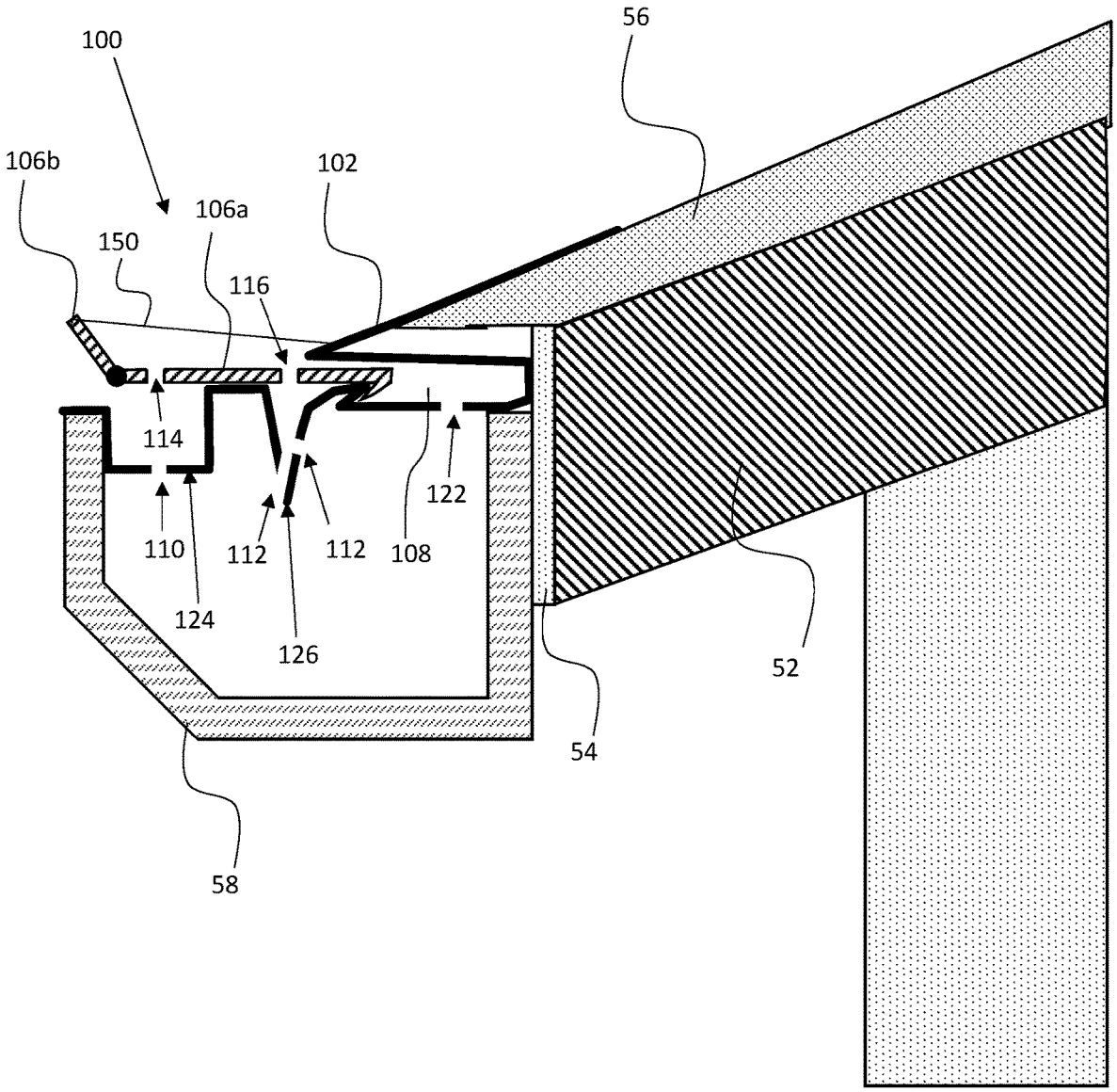
FIG. 19 is a side view of a gutter cover with an extended retractable plate having a hinged flap, according to some embodiments of the present invention.

FIG. 18 is a side view of a gutter cover with a retracted retractable plate having a hinged flap, according to some embodiments of the present invention. FIG. 19 is a side view of a gutter cover with an extended retractable plate having a hinged flap, according to some embodiments of the present invention.

The gutter cover 100 of FIGS. 18-19 is similar to the gutter cover 100 of FIGS. 1-5 and operates in the same manner described above. Optionally, the retractable plate 106 is moved by a more via a rack-and-pinion mechanism described above. The motor may be located on lateral side of the retractable plate, may be powered by a solar panel, and may be controlled by a control unit in communication with a rain sensor, as described above.

The gutter cover 100 of FIGS. 18-19 includes an upper hood panel 102, a lower cover panel 104, and a retractable plate 106.

The upper hood panel 102 is configured to be joined to an inclined roof sheathing 56 covering rafters 52 of a roof, to extend above a gutter 58 joined to a fascia 54 joined to the roof rafters 52, and to no more than partially shield the gutter from above 58.

The lower cover pane 104 is configured to be joined to the gutter 58 and to cover the gutter 58, such that a gap 108 is present between the upper hood plate 102 and the lower cover panel 104.

The retractable plate 106 is located above the lower cover plate 104, and is configured to be movable between a retracted configuration and an extended configuration. The retractable plate comprises a rear portion 106*a* and forward flap 106*b* hinged to the rear portion 106*a*. In the retracted configuration, the retractable plate 106 is at least partially retracted within the gap and is at least partially shielded by the upper hood panel 102 from above, and the forward flap 106*b* extends forward from (and optionally parallel to) the rear plate 106*a*.

In the extended configuration, the retractable plate 106 is at least partially located outside the gap 108 and covers at least most of a forward portion of the lower cover panel 104, the forward portion of the lower cover panel 104 being a portion that is not shielded by the upper hood panel 102.

The lower cover panel 104 has first openings (110, 112) to enable passage of rainwater from the lower cover plate into the gutter. The retractable plate 106 has second openings (114, 116), to enable passage of rainwater from the retractable plate to the lower cover panel.

In the extended configuration, the forward flap 106*b* rises upward from a forward edge of the rear portion 106*a*.

The gutter cover 100 of FIGS. 18-19 is advantageous when the gutter 58 is close to the roof sheathing 56. Therefore, the gap 108 between the upper hood panel 102 and the lower cover panel 104 is not large enough to cover the retractable plate's forward flap 106*b* when the forward flap 106*b* is raised. The forward flap is only raised only when the retractable plate 106 is in its extended configuration.

When there is no rainfall, the retractable plate 106 is retracted inside the gap 108 and is partially or completely covered by the upper hood panel 102 from above, as shown in FIG. 18.

When rainfall is detected, the retractable plate is extended as seen in FIG. 19, and the forward flap 106*b* is raised. Rainwater may slide from the upper hood panel 102 directly onto the rear portion 106*a* of lower cover 106 or may be is stopped by the raised forward flap 106*b*, thereby preventing the rainwater from bypassing the gutter 58.

In some embodiments of the present invention, the angle between the rear portion 106*a* and the forward flap 106*b* is an obtuse angle, for example 135 degrees (±15%).

In some embodiments of the present invention, the lower cover panel 104 has a front trough 124 with first front openings 110, while the retractable plate 106 has second front openings 114, as explained above. When the retractable plate 106 is in the extended configuration, the second front openings 114 are aligned with the front trough 124.

In some embodiments of the present invention, the lower cover panel 104 has a rear trough 126 with first rear openings 112, while the retractable plate 106 has second rear openings 116, as explained above. When the retractable plate 106 is in the extended configuration, the second rear openings 116 are aligned with the rear trough 126. In the embodiments in which the rear trough 126 is not covered by the upper hood plate 102, the first front openings 114 may be aligned with the rear trough 126 when the retractable plate 106 is in the retracted configuration, in order to ease the passage of rainwater into the gutter 58.

As explained above, the retractable plate 106 may include an extension 118, while the lower cover panel 104 includes a hem 120. The extension 118 and is caught by the hem 120 as to stop the forward motion of the retractable plate 106 and prevent the retractable plate from moving too far and falling from the bottom cover plate 104.

In some embodiments of the present invention, the gutter cover 100 includes a cord 150 having a first end joined to the upper hood panel 102 or to the lower cover panel 104 and second end joined to the forward flap 106*b*. When the retractable plate 106 is in the retracted configuration, the cord 150 is slack, thereby enabling the forward flap 106*b* to fall. When the retractable plate 106 is in the extended configuration, the cord tenses, pulling the forward flap 106*b* upwards.

In some embodiments of the present invention, the hinge connecting the rear portion 106*a* to the forward flap 106*b* is a piano hinge.

What is claimed is:

1. A gutter cover configured to cover a gutter joined to a fascia of a roof, the gutter cover comprising:

a lower cover panel configured to be joined to a gutter joined to a fascia joined to a front of roof rafters, and to cover the gutter;

a retractable plate located above the lower cover panel, and configured to be movable between a retracted position above a rear end of the gutter in a vicinity of the fascia and an extended position ahead of the retracted position, the retractable plate comprising a rear portion and forward flap, the forward flap sloping upward from a forward edge of the rear portion;

wherein:

the lower cover panel has first openings to enable passage of water from the lower cover panel into the gutter;

the retractable plate is configured to lead water from the retractable plate to the lower cover panel.

2. The gutter cover of claim 1, wherein the forward flap slopes upward and forward at an obtuse angle from the rear portion.

3. The gutter cover of claim 1, wherein the retractable plate has second openings to lead water from the retractable plate to the lower cover panel.

4. The gutter cover of claim 1, wherein:

the lower cover panel comprises a forward trough having a lip which is configured to be joined to a rim on a front end of the gutter;

the first openings comprise a set of first front openings on the forward trough.

5. The gutter cover of claim 4, wherein:

the retractable plate has second front openings to lead water from the retractable plate to the lower cover panel;

the second openings comprise a set of second front openings which align with the forward trough of the lower cover panel when the retractable plate is in the extended configuration, such that water is led from the retractable plate into the forward trough via the second front openings and is led from the forward trough into the gutter via the first front openings.

6. The gutter cover of claim 4, wherein:

the lower cover panel further comprises a rear trough located between the forward trough and a rear end of the lower cover; and the first openings comprise a set of first rear openings on the rear trough.

7. The gutter cover of claim 6, wherein:

the retractable plate has second openings to lead water from the retractable plate to the lower cover panel;

the second openings comprise a set of second rear openings which align with the rear trough of the lower cover panel when the retractable plate is in the extended configuration, such that water is led from the retractable plate into the rear trough via the second rear openings and is led from the rear trough into the gutter via the first rear openings.

8. The gutter cover of claim 1, further comprising:

a motor comprising a shaft and configured to rotate the shaft about a longitudinal axis of the shaft, the motor being configured to be fixed to at least one of: the gutter, the upper hood panel, and the lower cover panel;

a circular gear joined concentrically to the shaft and configured to rotate with the shaft;

a track joined to a lateral side of the retractable plate and configured to mesh with the circular gear, such that rotation of the circular gear moves the track and thereby linearly moves the retractable plate to which the track is joined at least from the retracted configuration to the extended configuration.

9. The gutter cover of claim 8, comprising a solar panel configured to generate electricity to power the motor.

10. The gutter cover of claim 8, comprising a spiral spring wound about the shaft with a first end joined to the shaft and a second end joined to a fixed location;

wherein the spiral spring is configured to tighten about the shaft as the shaft rotates to move the retractable plate from the retracted configuration to the extended configuration;

wherein, when the motor stops rotation of the shaft, the motor stops applying torque to the shaft and the spiral spring is configured to unwind and thereby rotate the shaft to move the retractable plate from the extended configuration to the retracted configuration.

11. The gutter cover of claim 8, comprising a spring having a first end joined to the retractable plate and a second end joined to the any part of the roof or the upper hood panel or lower cover panel;

wherein the spring is configured to extend when the retractable plate is moved from the retracted configuration to the extended configuration;

wherein, when the motor stops rotation of the shaft, the motor stops applying torque to the shaft and the spring is configured to return to an equilibrium length thereof, thereby pulling the retractable plate from the extended configuration to the retracted configuration.

12. The gutter cover of claim 8, comprising a rain sensor and a control unit in communication with the motor, wherein:

the rain sensor is configured to detect rainfall, and to generate a first signal when rainfall is detected;

the control unit is configured to receive the first signal, identify a change between absence and presence of the first signal, and to control the motor to extend the retractable plate when a change from the absence to the presence of the first signal is identified and to retract the retractable plate when a change from the presence to the absence of the first signal is identified.

13. The gutter cover of claim 8, comprising a rain sensor, wherein:

the rain sensor comprises a relay between a power source and the motor, the relay being open when moisture is below a predetermined level and closed when moisture is above the predetermined level;

when moisture is above the predetermined level, the closed relay enables passage of electrical power to the motor and activates the motor to move the retractable plate to the extended configuration;

when moisture is below the predetermined level, the open relay prevents the passage of electrical power to the motor and deactivates the motor, such that no torque is applied on the shaft by the motor.

14. The gutter cover of claim 1, further comprising an upper hood panel, configured to extend above the gutter, and to no more than partially shield the gutter from above;

wherein a gap is present between the upper hood panel and the lower cover panel;

wherein in the retracted position, the retractable plate is within the gap;

wherein in the extended position, the retractable plate is at least partially located outside the gap.

15. The gutter cover of claim 1, further comprising an upper hood panel, configured to extend above the gutter, and to no more than partially shield the gutter from above;

wherein a gap is present between the upper hood panel and the lower cover panel;

wherein in the retracted position, the retractable plate is at least partially retracted within the gap;

wherein in the extended position, the retractable plate is at least partially outside the gap;

wherein the retractable plate comprises a rear portion and forward flap hinged to the rear portion;

wherein in the retracted configuration, the forward flap extends forward from rear portion;

wherein in the extended configuration, the forward flap rises upward from a forward edge of the rear portion.

16. The gutter cover of claim 1, wherein:

the retractable plate comprises a rear portion and forward flap hinged to the rear portion;

in the retracted configuration, the forward flap extends forward from rear portion;

in the extended configuration, the forward flap rises upward from a forward edge of the rear portion.

17. The gutter cover of claim 1, wherein:

an extension protrudes under the retractable plate;

a hem is formed on the lower cover panel, and is configured to catch the extension to stop a forward motion of the retractable plate beyond the extended position.

* * * * *